US006368778B1

(12) United States Patent
Kong et al.

(10) Patent No.: US 6,368,778 B1
(45) Date of Patent: Apr. 9, 2002

(54) PHOTOTHERMOGRAPHIC MATERIALS PROVIDING IMPROVED IMAGE STABILITY AND METHODS OF USE

(75) Inventors: Steven H. Kong, Woodbury; Paul G. Skoug, Stillwater; Kumars Sakizadeh, Woodbury, all of MN (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/638,679

(22) Filed: Aug. 15, 2000

(51) Int. Cl.[7] ..... G03C 1/498; G03C 1/34

(52) U.S. Cl. ..... 430/350; 430/607; 430/613; 430/614; 430/617; 430/619

(58) Field of Search ..... 430/619, 607, 430/613, 614, 350, 617

(56) References Cited

U.S. PATENT DOCUMENTS

| | | | |
|---|---|---|---|
| 3,707,377 | A | 12/1972 | Tiers et al. |
| 3,874,946 | A | 4/1975 | Costa et al. |
| 6,093,529 | A | 7/2000 | Tsuzuki et al. |

FOREIGN PATENT DOCUMENTS

| | | |
|---|---|---|
| EP | 0 266 733 | 5/1988 |
| EP | 0 573 048 A2 | 12/1993 |
| FR | 2.009.253 | 5/1969 |
| GB | 1 243 060 | 8/1971 |
| GB | 1 365 966 | 5/1973 |
| GB | 1 319 763 | 6/1973 |
| GB | 1 565 043 | 4/1980 |

OTHER PUBLICATIONS

JP Abstract—01–173034.

JP Abstract—1–207005.

Research Disclosure, 23136, 7/83, pp 249–250.

*Primary Examiner*—Thorl Chea
(74) *Attorney, Agent, or Firm*—J. Lanny Tucker

(57) ABSTRACT

Photothermographic materials provide images having improved image stability due to the presence of certain image stabilizing compounds in a silver-containing layer. These image stabilizing compounds are fluorenone, fluorene, coumarin, naphthalic acid imide, pyrazoline, or anthracene compounds. In particular, they reduce image browning that may occur from the presence of various components in the materials.

30 Claims, No Drawings

PHOTOTHERMOGRAPHIC MATERIALS PROVIDING IMPROVED IMAGE STABILITY AND METHODS OF USE

FIELD OF THE INVENTION

The present invention relates to thermally-developable imaging materials such as photothermographic materials. More particularly, it relates to photothermographic imaging materials that provide images that are more stable to light and heat over time particularly under light-box conditions. The invention also relates to methods of imaging using these materials. This invention is directed to the photothermographic imaging industry.

BACKGROUND OF THE INVENTION

Silver-containing thermographic and photothermographic imaging materials (that is, heat-developable photographic materials) that are developed with heat and without liquid development have been known in the art for many years.

Thermography or thermal imaging is a recording process wherein images are generated by the use of thermal energy. In direct thermography, a visible image is formed by imagewise heating a recording material containing components that changes color or optical density upon heating. Thermographic materials generally comprise a support having coated thereon: (a) a relatively or completely non-photosensitive source of reducible silver ions, (b) a reducing system (usually including a developer) for the reducible silver ions, and (c) a hydrophilic or hydrophobic binder.

Thermal recording materials become photothermographic upon incorporating a photosensitive catalyst such as silver halide. Upon imagewise exposure to irradiation energy (ultraviolet, visible or IR radiation) the exposed silver halide grains form a latent image. Application of thermal energy causes the latent image of exposed silver halide grains to act as a catalyst for the development of the non-photosensitive source of reducible silver to form a visible image. These photothermographic materials are also known as "dry silver" materials.

In such materials, the photosensitive compound is generally a photographic type photosensitive silver halide that is considered to be in catalytic proximity to the non-photosensitive source of reducible silver ions. Catalytic proximity requires intimate physical association of these two components either prior to or during the thermal image development process so that when silver atoms ($Ag^o$, also known as silver specks, clusters or nuclei) are generated by irradiation or light exposure of the photosensitive silver halide, those silver atoms are able to catalyze the reduction of the reducible silver ions within a catalytic sphere of influence around the silver atoms [Klosterboer, Neblette's Eighth Edition: *Imaging Processes and Materials*, Sturge, Walworth & Shepp (Eds.), Van Nostrand-Reinhold, New York, Chapter 9, pages 279–291, 1989]. It has long been understood that silver atoms act as a catalyst for the reduction of silver ions, and that the photosensitive silver halide can be placed into catalytic proximity with the reducible silver ions in a number of different fashions (see, for example, *Research Disclosure*, June 1978, Item No. 17029). Other photosensitive catalysts such as titanium dioxide and zinc oxide can be used in place of silver halide.

The photosensitive silver halide may be made "in situ," for example by mixing a halogen-containing source (either organic or inorganic halogen source) with the source of reducible silver ions to achieve partial methasis and thus causing the in-situ formation of silver halide (AgX) grains throughout the reducible silver ion source [see, for example, U.S. Pat. No. 3,457,075 (Morgan et al.)], by coprecipitation of the silver halide and the reducible silver ion source [see for example U.S. Pat. No. 3,839,049 (Simons)], or by complete conversion of a portion of the silver ions to the silver halide and adding that portion back to the reducible silver ion source.

The silver halide may also be pre-formed and prepared by an ex situ process whereby the silver halide (AgX) grains are prepared and grown separately in an aqueous or an organic solvent before mixing and/or coating with the source of reducible silver ions. With this technique, one has the possibility of controlling the grain size, grain size distribution, dopant levels, and composition much more precisely, so that one can impart more specific properties to the photothermographic material.

The non-photosensitive source of reducible silver ions is a material that contains silver ions. Typically, the preferred non-photosensitive source of reducible silver ions is a silver salt of a long chain aliphatic carboxylic acid having from 10 to 30 carbon atoms, or mixtures of such salts. Salts of other organic acids or other organic compounds, such as silver imidazolates, silver benzotriazoles, silver benzotetrazoles, silver benzothiazoles and silver acetylides have also been proposed. U.S. Pat. No. 4,260,677 (Winslow et al.) discloses the use of complexes of various inorganic or organic silver salts.

In photothermographic emulsions, exposure of the photographic silver halide to light produces small clusters of silver atoms ($Ag^o$) in what is known in the art as a latent image. This latent image is generally not visible by ordinary means. Thus, the photosensitive emulsion must be further developed to produce a visible image by the reduction of silver ions that are in catalytic proximity to the silver halide grains bearing the clusters of silver atoms. This produces a black-and-white image. The non-photosensitive silver source is reduced to form the visible black-and-white negative image while much of the silver halide, generally, remains as silver halide and is not reduced depending upon the reducing agent in the materials.

In both thermographic and photothermographic materials, the reducing agent for the reducible silver ions often referred to as a "developer," may be any compound that can reduce silver ion to metallic silver and is preferably of relatively low activity until it is heated to a temperature sufficient to cause the reaction. A wide variety of classes of compounds have been disclosed in the literature that function as developers for both thermographic and photothermographic materials. At elevated temperatures, the reducible silver ions are reduced by the reducing agent. In thermographic materials, simply heating above the development temperature is sufficient to cause the reduction reaction. In photothermographic materials, upon heating, this reaction occurs preferentially in the regions surrounding the latent image. In both thermographic and photothermographic materials, this reaction produces an image of metallic silver having a color that ranges from yellow to deep black depending upon the presence of toning agents and other components in the imaging emulsion.

Differences Between Photothermography and Photography

The imaging arts have long recognized that the field of photothermography is clearly distinct from that of photography. Photothermographic materials differ significantly from conventional silver halide photographic materials that require processing using aqueous processing solutions.

In photothermographic imaging materials, a visible image is created by heat as a result of the reaction of a developer incorporated within the material. Heating at 50° C. or more is essential for this dry development. In contrast, conventional wet-processed photographic imaging materials require processing in aqueous processing baths to provide a visible image at more moderate temperatures (from 30° C. to 50° C.).

In photothermographic materials, only a small amount of silver halide is needed to capture light and a different form of silver (for example a silver carboxylate) is used to generate the image using thermal development. Thus, the silver halide serves as a catalyst for the physical development of the reducible silver ions. In contrast, conventional wet-processed, black-and-white photographic materials use only one form of silver that, upon chemical development, is itself converted into the silver image, or that upon physical development requires addition of an external silver source. Thus, photothermographic materials require an amount of silver halide per unit area that is only a fraction of that used in conventional wet-processed photographic materials.

In photothermographic materials, all of the "chemistry" for imaging is incorporated within the material itself. For example, they include a developer (that is a reducing agent) while conventional photographic materials do not. Even in so-called instant photography, the developer chemistry is physically separated from the photosensitive silver halide until development is desired. The incorporation of the developer into photothermographic materials can lead to increased formation of various types of "fog" or other undesirable sensitometric side effects. Therefore, much effort has gone into the preparation and manufacture of photothermographic materials to minimize these problems during the preparation of the photothermographic emulsion as well as during coating, storage, and post-processing handling processes.

Moreover, in photothermographic materials, the unexposed silver halide generally remains intact after development and the image must be stabilized against further imaging and development. In contrast, the silver halide is removed from photographic materials after development to prevent further imaging (that is during the fixing step).

In photothermographic materials, the binder is capable of wide variation and a number of binders (both hydrophilic and hydrophobic) are useful. In contrast, conventional photographic materials are limited almost exclusively to hydrophilic colloidal binders such as gelatin.

Because photothermographic materials require dry thermal processing, they pose different considerations and present distinctly different problems in manufacture and use, compared to conventional, wet-processed silver halide materials. In addition, the effects of additives (for example, stabilizers, antifoggants, speed enhancers, sensitizers and supersensitizers) that are intended to have a direct effect upon the imaging process, can vary depending upon whether they have been incorporated in a photothermographic material or incorporated in a photographic material. Furthermore, certain stabilizers are required in photothermographic materials that have quite distinctive properties, such as those that provide brominating properties (for example, tribromomethyl antifoggants).

The benefits of using such additives in one type of material (for example photographic materials) are not predictive of whether such additives will provide a desired benefit in photothermographic materials. Additives that have one effect in conventional silver halide photography may behave quite differently in photothermographic materials where the underlying chemistry is so much more complex. For example, it is not uncommon for a photographic antifoggant for a silver halide system to cause various types of fog when incorporated into photothermographic materials. Furthermore, some supersensitizers that are effective for photographic materials are inactive in photothermographic materials.

These and other distinctions between photothermographic and photographic materials are described in *Imaging Processes and Materials* (*Neblette's Eighth Edition*), noted above, *Unconventional Imaging Processes*, E. Brinckman et al (Eds.), The Focal Press, London and New York, 1978, pages 74–75, and in Zou, Shayun, Levy and Serpone, *J. Imaging Sci. Technol.* 1996, 40, pages 94–103.

Problem to be Solved

Medical images are used by radiologists to consider a patient's condition and to make medical diagnosis. These images are typically viewed on light boxes that are illuminated by fluorescent light and that emit heat over time. Some thermally-developable photothermographic materials used in radiology are more sensitive to those light and heat conditions than others. For example, photothermographic materials that contain what may be defined as "polyhalo" antifoggants, or antifogging compounds that have moieties that include di- or trihalo groups (such as dichloro, trichloro and tribromo groups) tend to be less stable. The images can begin "browning" prematurely under some conditions of light and heat. Browning can also occur when silver bromides are used as the photosensitive source of silver ions (that is, the photocatalyst) in photothermographic materials. The various causes and mechanisms of image instability in photothermographic materials is not fully understood, so it is unpredictable as to what means can be used to solve these problems.

The use of optical brightening compounds to protect imaging materials from fading, color change or static fogging is well known. Such compounds have also been used as optical brighteners in heat developable materials. GB 1,565,043 (Fuji Photo) describes putting certain optical brighteners containing benzoxazoylyl groups in heat-sensitive emulsion layers, subbing layers or in the support itself, and keeping the optical brighteners separate from tribromomethyl antifoggants to avoid interaction between the two types of compounds.

However, it is not predictable as to what compound may prevent image degradation or browning in heat-sensitive materials because the sources image instability are not fully understood. What may suppress browning from one source may not accomplish the desired result from another source.

There is a need in the industry for photothermographic materials that provide images that are more stable to heat and light, such as the conditions under which they are viewed on light boxes. Further, there is a need in the industry for a means to reduce browning caused by the presence of polyhalo antifoggants.

In copending and commonly assigned U.S. Ser. No. 09/638,788 filed on even date herewith by Kong and Sakizadeh (Attorney Docket 80071) and entitled PHOTOTHERMOGRAPHIC MATERIALS CONTAINING BACKSIDE IMAGE STABILIZING COMPOUNDS, image stability is improved by putting certain image stabilizing compounds in a layer on the backside of the support. While this invention provides a desirable advance in the art, it would be preferable to find a way to improve image stability by modifying the photothermographic layer(s) on the frontside of the support.

SUMMARY OF THE INVENTION

The problems noted above with image instability in thermally-developable imaging materials have been over-come using a photothermographic material comprising a support having thereon one or more frontside layers comprising a binder, and in reactive association:

(a) a silver halide, (b) a non-photosensitive source of reducible silver ions, and (c) a reducing agent composition for the reducible silver ions, the material further comprising in the one or more frontside silver-containing layers, one or more primary image stabilizing compounds that are naphthalic acid imide, pyrazoline, fluorenone, fluorene, coumarin, or anthracene compounds.

In preferred embodiments, these photothermographic materials also include in one or more of the frontside layers a polyhalo antifoggant that is defined in more detail below.

This invention further comprises a method for preparing the photothermographic material described above comprising:

A) applying to a support one or more formulations to form one or more layers on one side of the support, the one or more formulations including components (a), (b) and (c) identified above and thereby forming one or more silver-containing layers, B) simultaneously or sequentially, applying a second formulation including the one or more image stabilizing compounds described above to form a layer that is different from the layers formed in A), and C) allowing the one or more image stabilizing compounds to diffuse into a silver-containing layer formed in A).

This invention also provides a method of providing an image comprising:

(A) imagewise exposing the photothermographic material described above to form a latent image, and (B) simultaneously or sequentially, heating the photothermographic material to provide a visible image.

It has been found that certain image stabilizing compounds in one or more silver-containing layers on the frontside of the support of photothermographic materials can improve image stability of those materials, particularly under light-box conditions. This improvement is particularly noticeable in photothermographic materials that contain "polyhalo" antifoggants (defined below) in one or more imaging or emulsion layers. Thus, the browning sometimes seen in images in such materials is reduced or avoided entirely. These results are achieved without adversely affecting the desired sensitometric properties of the materials.

While the image stabilizing compounds must be in a silver-containing layer, particularly the photothermographic imaging layer, for the desired image stabilizing effect, it need not be incorporated directly into the silver-containing layer during manufacture. In some embodiments, the image stabilizing compound(s) can be incorporated into an upper layer such as a topcoat and allowed to diffuse into the lower silver-containing layer(s).

It is also desirable that the image stabilizing compounds be used in such a manner that "yellowness" is not unsuitably increased in the non-imaged materials compared to the color of the same materials not having the image stabilizing compounds. "Yellowness" and other color hues can be measured using the conventional CIE lab scale using the conventional a* and b* values (Commission Internationale de l'Eclairage). The a* value is a measure of redness (positive a* value), and the b* value is a measure of yellowness (positive b*). In the present invention, the type and amount of image stabilizing compound(s) in the photothermographic materials must be such that the change in b* ($\Delta b^*$) due to their presence is no greater than +10 b* units, and preferably no greater than +4 b* units.

DETAILED DESCRIPTION OF THE INVENTION

The photothermographic materials of this invention can be used, for example, in conventional black-and-white photothermography, in electronically generated black-and-white hardcopy recording, in the graphic arts area (for example imagesetting and phototypesetting), in proofing, in microfilm applications and in radiographic imaging. Furthermore, the absorbance of these photothermographic materials is sufficiently low to permit their use in graphic arts applications.

In the photothermographic materials of this invention, the components needed for imaging can be in one or more layers. The layer(s) that contain the photosensitive silver halide and non-photosensitive source of reducible silver ions are referred to herein as emulsion layer(s). The silver halide and the non-photosensitive source of reducible silver ions are in catalytic proximity (or reactive association) and preferably in the same layer.

According to the present invention, the image stabilizing compounds described in more detail below are in one or more layers on the frontside of the support [that is on the same side as the emulsion layer(s)].

Layers on the "frontside" or emulsion side of the support can include protective topcoat layers, primer layers, interlayers, opacifying layers, antistatic layers, acutance layers, barrier layers, subbing layers, auxiliary layers and others readily apparent to one skilled in the art.

Layers on the "backside" (opposite the emulsion layer) can include antihalation, conductive layers, antistatic layers, protective layers and any other layer readily apparent to one skilled in the art.

The present invention also provides a process for the formation of a visible image by first exposing to electromagnetic radiation and thereafter heating the inventive photothermographic material. In one embodiment, the present invention provides a process comprising:

A) exposing the photothermographic material of this invention to electromagnetic radiation to which the silver halide of the material is sensitive, to generate a latent image, and B) simultaneously or sequentially heating the exposed material to develop the latent image into a visible image.

When the photothermographic materials used in this invention are heat-developed as described below in a substantially water-free condition after, or simultaneously with, imagewise exposure, a silver image (preferably black-and-white silver image) is obtained. The material may be exposed in step A using ultraviolet, visible, infrared radiation such as from an infrared laser, a laser diode, an infrared laser diode, a light-emitting screen, CRT tube, LED or another light source readily apparent to one skilled in the art.

In the descriptions of the photothermographic materials of the present invention, "a" or "an" component refers to "at least one" of that component. For example, in the materials described above, the image stabilizing compounds described herein can be used individually or in mixtures.

Heating in a substantially water-free condition as used herein, means heating at a temperature of from about 50° to about 250° C. with little more than ambient water vapor present. The term "substantially water-free condition" means that the reaction system is approximately in equilibrium with water in the air and water for inducing or promoting the reaction is not particularly or positively supplied from the exterior to the material. Such a condition is described in T. H. James, *The Theory of the Photographic Process*, Fourth Edition, Macmillan 1977, page 374.

Definitions:

As used herein:

"Photothermographic material(s)" means a construction comprising at least one photothermographic emulsion layer or a "two trip" photothermographic set of layers (the "two-trip coating where the silver halide and the reducible silver ion source are in one layer and the other essential components or desirable additives are distributed as desired in an adjacent coating layer) and any supports, topcoat layers, image-receiving layers, blocking layers, antihalation layers, subbing or priming layers. These materials also include multilayer constructions in which one or more imaging components are in different layers, but are in "reactive association" so that they readily come into contact with each other during imaging and/or development. For example, one layer can include the non-photosensitive source of reducible silver ions and another layer can include the reducing composition, but the two reactive components are in reactive association with each other.

"Ultraviolet region of the spectrum" refers to that region of the spectrum less than or equal to about 410 nm, preferably from about 100 nm to about 410 nm, although parts of this range may be visible to the naked human eye. More preferably, the ultraviolet region of the spectrum is the region of from about 190 nm to about 405 nm.

"Visible region of the spectrum" refers to that region of the spectrum of from about 400 nm to about 750 nm.

"Short wavelength visible region of the spectrum" refers to that region of the spectrum from about 400 nm to about 450 nm.

"Red region of the spectrum" refers to that region of the spectrum of from about 600 nm to about 750 nm.

"Infrared region of the spectrum" refers to that region of the spectrum of from about 750 nm to about 1400 nm.

In the compounds used as image stabilizing compounds, substitution is not only tolerated, but is often advisable and substitution is anticipated on the compounds used in the present invention.

For the image stabilizing and other compounds disclosed herein, when a compound is referred to as "having the structure" of a given formula, any substitution that does not alter the bond structure of the formula or the shown atoms within that structure is included within the formula, unless such substitution is specifically excluded by language (such as "free of carboxy-substituted alkyl"). For example, where there is a benzene ring structure shown substituent groups may be placed on the benzene ring structure, but the atoms making up the benzene ring structure may not be replaced.

As a means of simplifying the discussion and recitation of certain substituent groups, the term "group," such as "aryl group," is used to describe both substituted and unsubstituted aryl substituents. For example, the phrase, "alkyl group" is intended to include not only pure hydrocarbon alkyl chains, such as methyl, ethyl, propyl, t-butyl, cyclohexyl, iso-octyl, octadecyl and the like, but also alkyl chains bearing substituents known in the art, such as hydroxyl, alkoxy, phenyl, halogen atoms (F, Cl, Br, and I), cyano, nitro, amino, carboxy, etc. For example, alkyl group includes ether groups (for example, $CH_3$—$CH_2$—$CH_2$—O—$CH_2$—), haloalkyls, nitroalkyls, carboxyalkyls, hydroxyalkyls, sulfoalkyls, and others readily apparent to one skilled in the art. Substituents that adversely react with other active ingredients, such as very strongly electrophilic or oxidizing substituents, would of course be excluded by the ordinarily skilled artisan as not being inert or harmless.

Other aspects, advantages, and benefits of the present invention are apparent from the detailed description, examples, and claims provided in this application.

The Photocatalyst

As noted above, the photothermographic materials of the present invention include one or more photosensitive silver halides in one or more frontside emulsion layer(s). Useful photosensitive silver halides include but are not limited to silver bromide, silver iodide, silver chloride, silver bromoiodide, silver chlorobromoiodide, silver chlorobromide and others readily apparent to one skilled in the art. Mixtures of various silver halides can also be used in any suitable proportion. Silver bromide and silver bromoiodide are more preferred, the later silver halide including up to 10 mol % silver iodide.

The silver halide may be in any form that is photosensitive including but not limited to, cubic, octahedral, rhombic dodecahedral, orthorhombic, tetrahedral, other polyhedral, or tabular morphologies and may have epitaxial growth of crystals thereon. Mixtures of silver halide grains having various morphologies can also be used in various proportions.

The silver halide grains may have a uniform ratio of halide throughout. They may have a graded halide content, with a continuously varying ratio of, for example, silver bromide and silver iodide or they may be of the core-shell-type, having a discrete core of one halide ratio, and a discrete shell of another halide ratio. Core-shell silver halide grains useful in photothermographic materials and methods of preparing these materials are described in U.S. Pat. No. 5,382,504 (Shor et al.). Iridium doped core-shell grains of this type are described in U.S. Pat. No. 5,434,043 (Zou et al.) and U.S. Pat. No. 5,939,249 (Zou).

The photosensitive silver halide can be added to the emulsion layer(s) in any fashion or formed in the emulsion layer as long as it is placed in catalytic proximity to the non-photosensitive source of reducible silver ions.

It is preferred that the silver halide be preformed and prepared by an ex-situ process. The silver halide grains prepared ex-situ may then be added to and physically mixed with the reducible silver ion source. It is more preferable to form the non-photosensitive source of reducible silver ions in the presence of ex-situ prepared silver halide. In this process, the reducible silver ions source, such as a long chain fatty acid silver carboxylate (commonly referred to as a silver "soap") is formed in the presence of the preformed silver halide grains. Co-precipitation of the source of reducible silver ions in the presence of silver halide provides a more intimate mixture of the two materials [see, for example U.S. Pat. No. 3,839,049 (Simons)]. Materials of this type are often referred to as "preformed soaps."

Preformed silver halide emulsions used in the material of this invention can be prepared by aqueous or organic processes and can be unwashed or washed to remove soluble salts. In the latter case, the soluble salts can be removed by chill setting and leaching or the emulsion can be coagulation washed [for example by the procedures described in U.S. Pat. No. 2,618,556 (Hewitson et al.), U.S. Pat. No. 2,614,928 (Yutzy et al.), U.S. Pat. No. 2,565,418 (Yackel), U.S. Pat. No. 3,241,969 (Hart et al.) and U.S. Pat. No. 2,489,341 (Waller et al.)] and by ultrafiltration to remove soluble salts.

It is also effective to use an in situ process in which a halogen-containing compound is added to an organic silver salt to partially convert the silver of the organic silver salt to silver halide. The halogen-containing compound can be inorganic (such as zinc bromide or lithium bromide) or organic (such as N-bromosuccinimide).

Additional methods of preparing these silver halide and organic silver salts and manners of blending them are described in Research Disclosure, June 1978, item 17029, U.S. Pat. No. 3,700,458 (Lindholm) and U.S. Pat. No. 4,076,539 (Ikenoue et al.), and JP Applications 13224/74, 42529176 and 17216/75. *Research Disclosure* is a publication of Kenneth Mason Publications Ltd., Dudley House, 12 North Street, Emsworth, Hampshire PO10 7DQ England (also available from Emsworth Design Inc., 147 West 24th Street, New York, N.Y. 10011).

The one or more light-sensitive silver halides used in the photothermographic materials of the present invention are preferably present in an amount of from about 0.005 to about 0.5 mole, more preferably from about 0.01 to about 0.25 mole per mole, and most preferably from about 0.03 to about 0.15 mole, per mole of non-photosensitive source of reducible silver ions.

The silver halide used in the present invention may be employed without modification. However, it is preferably chemically and/or spectrally sensitized in a manner similar to that used to sensitize conventional wet-processed silver halide photographic materials or state-of-the-art heat-developable photothermographic materials.

For example, the photothermographic material may be chemically sensitized with one or more chemical sensitizing agents, such as a compound containing sulfur, selenium, or tellurium, or with a compound containing gold, platinum, palladium, ruthenium, rhodium, iridium, or combinations thereof, a reducing agent such as a tin halide or a combination of any of these. The details of these procedures are described in James, *The Theory of the Photographic Process*, Fourth Edition, Chapter 5, pages 149 to 169. Suitable chemical sensitization procedures are also disclosed in U.S. Pat. No. 1,623,499 (Sheppard et al.), U.S. Pat. No. 2,399,083 (Waller et al.), U.S. Pat. No. 3,297,447 (McVeigh) and U.S. Pat. No. 3,297,446 (Dunn). One method of chemical sensitization is by oxidative decomposition of a spectral sensitizing dye in the presence of a photothermographic emulsion, as described in U.S. Pat. No. 5,891,615 (Winslow et al.).

The addition of sensitizing dyes to the photosensitive silver halides provides high sensitivity to ultraviolet, visible and infrared light by spectral sensitization. Thus, the photosensitive silver halides may be spectrally sensitized with various known dyes that spectrally sensitize silver halide. Non-limiting examples of sensitizing dyes that can be employed include cyanine dyes, merocyanine dyes, complex cyanine dyes, complex merocyanine dyes, holopolar cyanine dyes, hemicyanine dyes, styryl dyes, and hemioxanol dyes. The cyanine dyes, merocyanine dyes and complex merocyanine dyes are particularly useful. Suitable sensitizing dyes such as those described in U.S. Pat. No. 3,719,495 (Lea), U.S. Pat. No. 5,393,654 (Burrows et al.), U.S. Pat. No. 5,441,866 (Miller et al.) and U.S. Pat. No. 5,541,054 (Miller et al.), U.S. Pat. No. 5,281,515 (Delprato et al.) and U.S. Pat. No. 5,314,795 (Helland et al.) are effective in the practice of the invention.

An appropriate amount of sensitizing dye added is generally about $10^{-10}$ to $10^{-1}$ mole, and preferably, about $10^{-8}$ to $10^{-3}$ moles per mole of silver halide.

To enhance the speed and sensitivity of the photothermographic materials, it is often desirable to use one or more supersensitizers that increase the sensitivity to light. For example, preferred infrared supersensitizers are described in EP-A-0 559 228 (Philip Jr. et al.) and include heteroaromatic mercapto compounds or heteroaromatic disulfide compounds of the formulae: Ar—S—M and Ar—S—S—Ar, wherein M represents a hydrogen atom or an alkali metal atom. Ar represents a heteroaromatic ring or fused heteroaromatic ring containing one or more of nitrogen, sulfur, oxygen, selenium, or tellurium atoms. Preferably, the heteroaromatic ring comprises benzimidazole, naphthimidazole, benzothiazole, naphthothiazole, benzoxazole, naphthoxazole, benzoselenazole, benzotellurazole, imidazole, oxazole, pyrazole, triazole, thiazole, thiadiazole, tetrazole, triazine, pyrimidine, pyridazine, pyrazine, pyridine, purine, quinoline, or quinazolinone. However, compounds having other heteroaromatic rings are envisioned to be suitable supersensitizers.

The heteroaromatic ring may also carry substituents. Examples of preferred substituents are halogens (such as bromine and chlorine), hydroxy, amino, carboxy, alkyl groups (for example of 1 or more carbon atoms and preferably 1 to 4 carbon atoms) and alkoxy groups (for example of 1 or more carbon atoms and preferably of 1 to 4 carbon atoms).

Most preferred supersensitizers are 2-mercaptobenzimidazole, 2-mercapto-5-methylbenzimidazole, 2-mercaptobenzothiazole, and 2-mercapto-benzoxazole and mixtures thereof.

If used, a supersensitizer is generally present in an emulsion layer in an amount of at least about 0.001 mole per mole of silver in the emulsion layer. More preferably, a supersensitizer is present within a range of about 0.001 mole to about 1.0 mole, and most preferably, about 0.01 mole to about 0.3 mole, per mole of silver halide.

Non-Photosensitive Source of Reducible Silver Ions

The non-photosensitive source of reducible silver ions used in photothermographic materials of this invention can be any material that contains a source of reducible silver ions in catalytic association with the photocatalyst. Preferably, it is a silver salt that is comparatively stable to light and forms a silver image when heated to 50° C. or higher in the presence of an exposed photocatalyst (such as silver halide) and a reducing agent.

Silver salts of organic acids, particularly silver salts of long-chain fatty carboxylic acids are preferred. The chains typically contain 10 to 30, and preferably 15 to 28, carbon atoms. Suitable organic silver salts include silver salts of organic compounds having a carboxyl group. Examples thereof include a silver salt of an aliphatic carboxylic acid or a silver salt of an aromatic carboxylic acid. Preferred examples of the silver salts of aliphatic carboxylic acids include silver behenate, silver arachidate, silver stearate, silver oleate, silver laurate, silver caprate, silver myristate, silver palmitate, silver maleate, silver fumarate, silver tartarate, silver furoate, silver linoleate, silver butyrate, silver camphorate, and mixtures thereof, hydrocarbon chains having either or thio linkages, or sterically hindered substitution in the α- (on a hydrocarbon group) or ortho- (on an aromatic group) position. Preferred examples of the silver salts of aromatic carboxylic acid and other carboxyl group-containing compounds include, but are not limited to, silver benzoate, a silver-substituted benzoate, such as silver 3,5-dihydroxy-benzoate, silver o-methylbenzoate, silver m-methylbenzoate, silver p-methylbenzoate, silver 2,4-dichlorobenzoate, silver acetamidobenzoate, silver p-phenylbenzoate, silver gallate, silver tannate, silver phthalate, silver terephthalate, silver salicylate, silver phenylacetate, silver pyromellilate, a silver salt of 3-carboxymethyl-4-methyl-4-thiazoline-2-thione or others as described in U.S. Pat. No. 3,785,830 (Sullivan et al.), and silver salts of aliphatic carboxylic acids containing a thioether group as described in U.S. Pat. No. 3,330,663 (Weyde et al.). Soluble silver carboxylates having increased solubility in coating solvents and affording coatings with less light scattering can also be used. Such silver carboxylates are described in U.S. Pat. No. 5,491,059 (Whitcomb). Mixtures of any of the silver salts described herein can also be used if desired.

Silver salts of sulfonates are also useful in the practice of this invention. Such materials are described for example in U.S. Pat. No. 4,504,575 (Lee). Silver salts of sulfosuccinates are also useful as described for example in EP-A-0 227 141 (Leenders et al.).

Silver salts of compounds containing mercapto or thione groups and derivatives thereof can also be used. Preferred examples of these compounds include, but are not limited to, a silver salt of 3-mercapto-4-phenyl-1,2,4-triazole, a silver salt of 2-mercaptobenzimidazole, a silver salt of 2-mercapto-5-aminothiadiazole, a silver salt of 2-(2-ethylglycolamido)benzothiazole, silver salts of thioglycolic acids (such as a silver salt of a S-alkylthioglycolic acid, wherein the alkyl group has from 12 to 22 carbon atoms), silver salts of dithio-carboxylic acids (such as a silver salt of dithioacetic acid), a silver salt of thioamide, a silver salt of 5-carboxylic-1-methyl-2-phenyl-4-thiopyridine, a silver salt of mercaptotriazine, a silver salt of 2-mercaptobenzoxazole, silver salts as described in U.S. Pat. No. 4,123,274 (Knight et al.) (for example, a silver salt of a 1,2,4-mercaptothiazole derivative, such as a silver salt of 3-amino-5-benzylthio-1,2,4-thiazole), and a silver salt of thione compounds [such as a silver salt of 3-(2-carboxyethyl)-4-methyl-4-thiazoline-2-thione as disclosed in U.S. Pat. No. 3,201,678].

Furthermore, a silver salt of a compound containing an imino group can be used. Preferred examples of these compounds include but are not limited to, silver salts of benzotriazole and substituted derivatives thereof (for example, silver methylbenzotriazole and silver 5-chlorobenzotriazole), silver salts of 1,2,4-triazoles or 1-H-tetrazoles such as phenylmercaptotetrazole as described in U.S. Pat. No. 4,220,709 (deMauriac), and silver salts of imidazoles and imidazole derivatives as described in U.S. Pat. No. 4,260,677 (Winslow et al.). Moreover, silver salts of acetylenes can also be used, as described for example in U.S. Pat. No. 4,761,361 (Ozaki et al.) and U.S. Pat. No. 4,775,613 (Hirai et al.).

It is may also be convenient to use silver half soaps. A preferred example of a silver half soap is an equimolar blend of silver carboxylate and carboxylic acid, which analyzes for about 14.5% by weight solids of silver in the blend and which is prepared by precipitation from an aqueous solution of the sodium salt of a commercial carboxylic acid, or by addition of the free fatty acid to the silver soap. For transparent films a silver carboxylate full soap, containing not more than about 15% of free carboxylic acid and analyzing about 22% silver, can be used. For opaque photothermographic materials, different amounts can be used.

The methods used for making silver soap emulsions are well known in the art and are disclosed in *Research Disclosure*, April 1983, item 22812, *Research Disclosure*, October 1983, item 23419, U.S. Pat. No. 3,985,565 (Gabrielsen et al.) and the references cited above.

The photocatalyst and the non-photosensitive source of reducible silver ions must be in catalytic proximity (that is, reactive association). "Catalytic proximity" or "reactive association" means that they should be in the same emulsion layer, in adjacent layers, or in layers separated from each other by an intermediate layer that is thin and allows movement of the reactants to other layers. It is preferred that these reactive components be present in the same emulsion layer.

The one or more non-photosensitive sources of reducible silver ions are preferably present in an amount of about 5% by weight to about 70% by weight, and more preferably, about 10% to about 50% by weight, based on the total weight of the emulsion layers. Stated another way, the amount of the sources of reducible silver ions are generally present in the material in an amount of from about 0.001 to about 0.2 mol/m$^2$ of material, and preferably from about 0.01 to about 0.05 mol/m$^2$.

Reducing Agents

The reducing agent (or reducing agent composition comprising two or more components) for the reducible silver ions can be any material, preferably an organic material, that can reduce silver (I) ion to metallic silver. Conventional photographic developers such as methyl gallate, hydroquinone, substituted hydroquinones, hindered phenols, amidoximes, azines, catechol, pyrogallol, ascorbic acid (and derivatives thereof), leuco dyes and other materials readily apparent to one skilled in the art can be used in this manner as described for example in U.S. Pat. No. 6,020,117 (Bauer et al.).

In some instances, the reducing agent composition comprises two or more components such as a hindered phenol developer and a co-developer that can be chosen from the various classes of reducing agents described below. For example, hindered phenols may be used in combination with acrylonitrile compounds, hydrazides or other known co-developers described below.

Hindered phenol reducing agents are preferred. These are compounds that contain only one hydroxy group on a given phenyl ring and have at least one additional substituent located ortho to the hydroxy group. Hindered phenol developers may contain more than one hydroxy group as long as each hydroxy group is located on different phenyl rings. Hindered phenol developers include, for example, binaphthols (that is dihydroxybinaphthyls), biphenols (that is dihydroxybiphenyls), bis(hydroxynaphthyl)methanes, bis(hydroxy-phenyl)methanes, hindered phenols, and hindered naphthols each of which may be variously substituted.

Representative binaphthols include but are not limited to 1,1'-bi-2-naphthol, 1,1'-bi-4-methyl-2-naphthol and 6,6'-dibromo-bi-2-naphthol. For additional compounds see U.S. Pat. No. 3,094,417 (Workman) and U.S. Pat. No. 5,262,295 (Tanaka et al.), both incorporated herein by reference.

Representative biphenols include but are not limited to 2,2'-dihydroxy-3,3'-di-t-butyl-5,5-dimethylbiphenyl, 2,2'-dihydroxy-3,3',5,5'-tetra-t-butylbiphenyl, 2,2'-dihydroxy-3,3'-di-t-butyl-5,5'-dichloro-biphenyl, 2-(2-hydroxy-3-t-butyl-5-methylphenyl)-4-methyl-6-n-hexylphenol, 4,4'-dihydroxy-3,3',5,5'-tetra-t-butylbiphenyl and 4,4'-dihydroxy-3,3',5,5'-tetramethylbiphenyl. For additional compounds see U.S. Pat. No. 5,262,295 (noted above).

Representative bis(hydroxynaphthyl)methanes include but are not limited to 4,4'-methylenebis(2-methyl-1-naphthol). For additional compounds see U.S. Pat. No. 5,262,295 (noted above).

Representative bis(hydroxyphenyl)methanes include but are not limited to bis(2-hydroxy-3-t-butyl-5-methylphenyl) methane (CAO-5), 1,1-bis(2-hydroxy-3,5-dimethylphenyl)-3,5,5-trimethylhexane (NONOX or PERMANAX WSO), 1,1-bis(3,5-di-t-butyl-4-hydroxyphenyl)methane, 2,2-bis(4-hydroxy-3-methylphenyl)propane, 4,4-ethylidene-bis(2-t-butyl-6-methylphenol) and 2,2-bis(3,5-dimethyl-4-hydroxyphenyl)propane. For additional compounds see U.S. Pat. No. 5,262,295 (noted above).

Representative hindered phenols include but are not limited to 2,6-di-t-butylphenol, 2,6-di-t-butyl-4-methylphenol, 2,4-di-t-butylphenol, 2,6-dichlorophenol, 2,6-dimethylphenol and 2-t-butyl-6-methylphenol.

Representative hindered naphthols include but are not limited to 1-naphthol, 4-methyl-1-naphthol, 4-methoxy-1-naphthol, 4-chloro-1-naphthol and 2-methyl-1-naphthol. For additional compounds see U.S. Pat. No. 5,262,295 (noted above).

More specific alternative reducing agents that have been disclosed in dry silver systems including amidoximes such as phenylamidoxime, 2-thienyl-amidoxime and p-phenoxyphenylamidoxime, azines (for example 4-hydroxy-3,5-dimethoxybenzaldehydrazine), a combination of aliphatic carboxylic acid aryl hydrazides and ascorbic acid, such as 2,2'-bis(hydroxymethyl)-propionyl-betaphenyl hydrazide in combination with ascorbic acid, a combination of polyhydroxybenzene and hydroxylamine, a reductone and/or a hydrazine [for example, a combination of hydroquinone and bis(ethoxyethyl)hydroxylamine], piperidino-hexose reductone or formyl-4-methylphenylhydrazine, hydroxamic acids (such as phenylhydroxamic acid, p-hydroxyphenylhydroxamic acid, and o-alaninehydroxamic acid), a combination of azines and sulfonamidophenols (for example phenothiazine and 2,6-dichloro-4-benzenesulfonamidophenol), α-cyano-phenylacetic acid derivatives (such as ethyl α-cyano-2-methylphenylacetate and ethyl α-cyanophenylacetate), bis-o-naphthols [such as 2,2'-dihydroxyl-1-binaphthyl, 6,6'-dibromo-2,2'-dihydroxy-1,1 '-binaphthyl, and bis(2-hydroxy-1-naphthyl)methane], a combination of bis-o-naphthol and a 1,3-dihydroxy-benzene derivative (for example 2,4-dihydroxybenzophenone or 2,4-dihydroxy-acetophenone), 5-pyrazolones such as 3-methyl-1-phenyl-5-pyrazolone, reductones (such as dimethylaminohexose reductone, anhydrodihydro-amino-hexose reductone and anhydrodihydro-piperidone-hexose reductone), sulfonamidophenol reducing agents (such as 2,6-dichloro-4-benzenesulfonamido-phenol, and p-benzenesulfonamidophenol), 2-phenylindane-1,3-dione and similar compounds, chromans (such as 2,2-dimethyl-7-t-butyl-6-hydroxychroman), 1,4-dihydropyridines (such as 2,6-dimethoxy-3,5-dicarbethoxy-1,4-dihydropyridine), bisphenols [such as bis(2-hydroxy-3-t-butyl-5-methylphenyl)methane, 2,2-bis(4-hydroxy-3-methylphenyl) propane, 4,4-ethylidene-bis(2-t-butyl-6-methylphenol) and 2,2-bis(3,5-dimethyl-4-hydroxyphenyl)propane], ascorbic acid derivatives (such as 1-ascorbylpalmitate, ascorbylstearate and unsaturated aldehydes and ketones), 3-pyrazolidones, and certain indane-1,3-diones.

Still other useful reducing agents are described for example in U.S. Pat. No. 3,074,809 (Owen), U.S. Pat. No. 3,094,417 (Workman), U.S. Pat. No. 3,080,254 (Grant, Jr.) and U.S. Pat. No. 3,887,417 (Klein et al.). Auxiliary reducing agents may be useful as described in U.S. Pat. No. 5,981,151 (Leenders et al.).

Useful co-developer reducing agents can also be used as described for example in copending U.S. Ser. No. 09/239,182 (filed Jan. 28, 1999 by Lynch and Skoog). These compounds are generally defined as having the following formula:

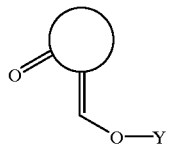

wherein Y is H, a metal cation (such as ammonium, alkali metals, alkaline earth metals but preferably, sodium or potassium), or an alkyl group (preferably, an alkyl group having from 1 to 4 carbon atoms, and more preferably, a methyl or ethyl group), and the solid curved line represents the atoms and bonds necessary to complete a 5- to 6-membered carbocyclic or heterocyclic main ring structure that may include heteroatoms (for example nitrogen, oxygen and sulfur). The main ring structure can include one or more additional rings, including pendant and fused rings.

The reducing agent (or mixture thereof) described herein is generally present as 1 to 10% (dry weight) of the emulsion layer. In multilayer constructions, if the reducing agent is added to a layer other than an emulsion layer, slightly higher proportions, of from about 2 to 15 weight % may be more desirable. Any co-developers may be present generally in an amount of from about 0.001% to about 1.5% (dry weight) of the emulsion layer coating.

Additional classes of reducing agents that can be used as co-developers are substituted hydrazines including the sulfonyl hydrazides described in U.S. Pat. No. 5,464,738 (Lynch et al.) and U.S. Pat. No. 5,492,803 (Landgrebe et al.), trityl hydrazides as described in U.S. Pat. No. 5,496,695 (Simpson et al.), formyl phenyl hydrazides as described in U.S. Pat. No. 5,545,505 (Simpson), 3-heteroaromatic-substituted acrylonitrile compounds as described in U.S. Pat. No. 5,635,339 (Murray) and 2-substituted malondialdehyde compounds as described in U.S. Pat. No. 5,654,130 (Murray).

Other Addenda

The photothermographic materials of the invention can also contain other additives such as shelf-life stabilizers, toners, antifoggants, contrast enhancers, development accelerators, acutance dyes, post-processing stabilizers or stabilizer precursors, and other image-modifying agents as would be readily apparent to one skilled in the art.

The photothermographic materials of the present invention can be further protected against the production of fog and can be stabilized against loss of sensitivity during storage. While not necessary for the practice of the invention, it may be advantageous to add mercury (II) salts to the emulsion layer(s) as an antifoggant. Preferred mercury (II) salts for this purpose are mercuric acetate and mercuric bromide.

Other suitable antifoggants and stabilizers that can be used alone or in combination include thiazolium salts as described in U.S. Pat. No. 2,131,038 (Staud) and U.S. Pat. No. 2,694,716 (Allen), azaindenes as described in U.S. Pat. No. 2,886,437 (Piper), triazaindolizines as described in U.S. Pat. No. 2,444,605 (Heimbach), mercury salts as described in U.S. Pat. No. 2,728,663 (Allen), the urazoles described in U.S. Pat. No. 3,287,135 (Anderson), sulfocatechols as described in U.S. Pat. No. 3,235,652 (Kennard), the oximes described in GB 623,448 (Carrol et al.), polyvalent metal salts as described in U.S. Pat. No. 2,839,405 (Jones), thiuronium salts as described in U.S. Pat. No. 3,220,839 (Herz), palladium, platinum and gold salts as described in U.S. Pat. No. 2,566,263 (Trirelli) and U.S. Pat. No. 2,597,915 (Damshroder), and 2-(tribromomethylsulfonyl)

quinoline compounds as described in U.S. Pat. No. 5,460,938 (Kirk et al.). Stabilizer precursor compounds capable of releasing stabilizers upon application of heat during development can also be used. Such precursor compounds are described in for example, U.S. Pat. No. 5,158,866 (Simpson et al.), U.S. Pat. No. 5,175,081 (Krepski et al.), U.S. Pat. No. 5,298,390 (Sakizadeh et al.) and U.S. Pat. No. 5,300,420 (Kenney et al.).

In addition, certain substituted-sulfonyl derivatives of benzotriazoles (for example alkylsulfonylbenzotriazoles and arylsulfonylbenzotriazoles) have been found to be useful stabilizing compounds (such as for post-processing print stabilizing), as described in copending U.S. Ser. No. 09/301,652 (filed Apr. 28, 1999 by Kong, Sakizadeh, LaBelle, Spahl and Skoug). Some of these compounds can be represented by the following structure:

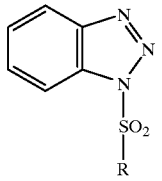

wherein R represents alkyl or alkenyl groups of up to 20 carbon atoms, aryl, alkaryl, or aralkyl groups comprising up to 20 carbon atoms, aliphatic heterocyclic ring groups containing up to 6 ring atoms or carbocyclic ring groups comprising up to 6 ring carbon atoms.

Furthermore, specific useful antifoggants/stabilizers can be represented by the structure:

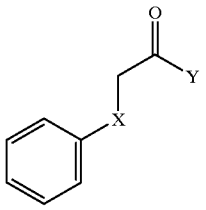

wherein X is —O— or —S—, and Y is —$NH_2$, —OH, or —$O^-M^+$wherein $M^+$is a metal atom, can be included in the imaging layers of the materials. These compounds and their use are described in more detail in U.S. Pat. No. 6,083,681 (Lynch et al.).

Other antifoggants are hydrobromic acid salts of heterocyclic compounds (such as pyridinium hydrobromide perbromide) and substituted propenitrile compounds as described for example in U.S. Pat. No. 5,594,143 (Kirk et al.), U.S. Pat. No. 5,028,523 (Skoug), U.S. Pat. No. 4,784,939 (Pham), U.S. Pat. No. 5,374,514 (Kirk et al.), U.S. Pat. No. 5,496,696 (Patel et al.), U.S. Pat. No. 5,686,228 (Murray et al.), U.S. Pat. No. 5,358,843 (Sakizadeh et al.) EP-A-0 600,589 (Philip, Jr. et al.), EP-A-0 600,586 (Philip, Jr. et al.) and EP-A-0 600,587 (Oliff et al.).

Preferably, the photothermographic materials of this invention include one or more polyhalo antifoggants that include one or more polyhalo substituents including but not limited to, dichloro, dibromo, trichloro and tribromo groups. The antifoggants can be aliphatic, alicyclic or aromatic compounds, including aromatic heterocyclic and carbocyclic compounds. Particularly useful antifoggants of this type include compounds A-1 through A-5 shown below:

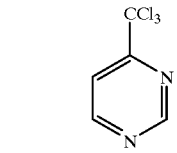

A-1

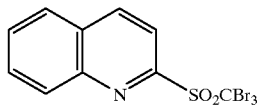

A-2

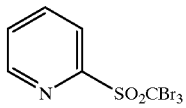

A-3

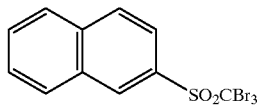

A-4

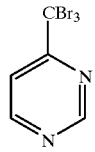

A-5

These polyhalo antifoggants are generally present in the photothermographic materials in one or more layers at a total concentration of at least 0.04 mmol/$m^2$, and preferably from about 0.1 to about 1 mmol/$m^2$.

The use of "toners" or derivatives thereof that improve the image is highly desirable. Preferably, if used, a toner can be present in an amount of about 0.01% by weight to about 10%, and more preferably about 0.1% by weight to about 10% by weight, based on the total dry weight of the layer in which it is included. Toners are usually incorporated in the photothermographic emulsion layer(s). Toners are well known materials in the photothermographic art, as shown in U.S. Pat. No. 3,080,254 (Grant, Jr.), U.S. Pat. No. 3,847,612 (Winslow), U.S. Pat. No. 4,123,282 (Winslow), U.S. Pat. No. 4,082,901 (Laridon et al.), U.S. Pat. No. 3,074,809 (Owen), U.S. Pat. No. 3,446,648 (Workman), U.S. Pat. No. 3,844,797 (Willems et al.), U.S. Pat. No. 3,951,660 (Hagemann et al.), U.S. Pat. No. 5,599,647 (Defieuw et al.) and GB 1,439,478 (AGFA).

Examples of toners include but are not limited to phthalimide and N-hydroxyphthalimide, cyclic imides (such as succinimide), pyrazoline-5-ones, quinazolinone, 1-phenylurazole, 3-phenyl-2-pyrazoline-5-one, and 2,4-thiazolidinedione, naphthalimides (such as N-hydroxy-1,8-naphthalimide), cobalt complexes (such as cobaltic hexamine trifluoroacetate), mercaptans (such as 3-mercapto-1,2,4-triazole, 2,4-dimercaptopyrimidine, 3-mercapto-4,5-diphenyl-1,2,4-triazole and 2,5-dimercapto-1,3,4-thiadiazole), N-(aminomethyl)aryl-dicarboximides [such as (N,N-dimethylaminomethyl)phthalimide, and N-(dimethylaminomethyl)naphthalene-2,3-dicarboximide, a combination of blocked pyrazoles, isothiuronium derivatives, and certain photobleach agents [such as a combination of N,N'-hexamethylene-bis(l-carbamoyl-3,5-dimethyl-pyrazole), 1,8-(3,6-diazaoctane)bis (isothiuronium)trifluoroacetate, and 2-(tribromomethylsulfonyl benzothiazole)], merocyanine dyes {such as 3-ethyl-5-[(3-ethyl-2-benzothiazolinylidene)-1-methyl-ethylidene]-2-thio-2,4-o-azolidine-dione}, phthalazine and derivatives thereof, phthalazinone and phthalazinone derivatives, or metal salts or these derivatives [such as 4-(1-naphthyl)-phthalazinone, 6-chlorophthalazinone, 5,7-dimethoxyphthalazinone, and 2,3-dihydro-1,4-phthalazinedione], a combination of phthalazine (or derivative thereof) plus one or more phthalic acid derivatives (such as phthalic acid, 4-methylphthalic acid, 4-nitrophthalic acid, and tetrachlorophthalic anhydride), quinazolinediones, benzoxazine or naphthoxazine derivatives, rhodium complexes functioning not only as tone modifiers but also as sources of halide ion for silver halide formation in situ [such as ammonium hexachlororhodate (III), rhodium bromide, rhodium nitrate, and potassium hexachlororhodate (III)], inorganic peroxides and persulfates (such as ammonium peroxydisulfate and hydrogen peroxide), benzoxazine-2,4-diones (such as 1,3-benzoxazine-2,4-dione, 8-methyl-1,3-benzoxazine-2,4-dione and 6-nitro-1,3-benzoxazine-2,4-dione), pyrimidines and asym-triazines (such as 2,4-dihydroxypyrimidine, 2-hydroxy-4-amino-pyrimidine and azauracil) and tetraazapentalene derivatives [such as 3,6-dimercapto-1,4-diphenyl-1H,4H-2,3a,5,6a-tetraazapentalene and 1,4-di-(o-chlorophenyl)-3,6-dimercapto-1H,4H-2,3a,5,6a-tetraazapentalene].

Various contrast enhancers can be used in some photothermographic materials, with or without specific co-developers. Examples of useful contrast enhancers include, but are not limited to, hydroxylamine, alkanolamines and ammonium phthalamate compounds as described for example in U.S. Pat. No. 5,545,505 (Simpson), hydroxamic acid compounds as described for example in U.S. Pat. No. 5,545,507 (Simpson et al.), and N-acylhydrazine compounds as described for example in U.S. Pat. No. 5,558,983 (Simpson et al.).

The advantages of the present invention are achieved by incorporating, as a primary stabilizing compound, one or more image stabilizing agents in one or more of the frontside silver-containing layers (for example, photothermographic emulsion layers) to provide the desired image stability for several days when exposed to heat and light common with light-boxes. As pointed out above, these compounds cause minimal increase in "yellowness" when incorporated into the one or more frontside layers.

These image stabilizing agents can be incorporated directly into one or more silver-containing layers (that is a layer containing either the silver halide or the source of reducible silver ions) by including it in one or more silver containing formulations, or they can be coated in a formulation (such as a topcoat formulation) and allowed to diffuse or migrate into a silver containing layer.

Such ultraviolet light absorbing light box stabilizing agents are chosen from one or more of several classes of UV absorbing compounds: fluorenones, fluorenes, coumarins, naphthalic acid imides, pyrazolines, and anthracenes (all described in detail below).

In addition, one or more of such primary image stabilizing compounds can be used in combination with one or more other secondary image stabilizing compounds that do not fall within any of the noted four classes of primary compounds. These secondary image stabilizing compounds can be represented by the following Structure I:

I

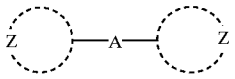

wherein Z is a 2-benzoxazoyl group, a benzothiazolyl group, a triazinyl group, or a benzimidazolyl group, and A is a bridging group that forms a continuous chain of conjugated double or triple bonds with the Z group and is most preferably:

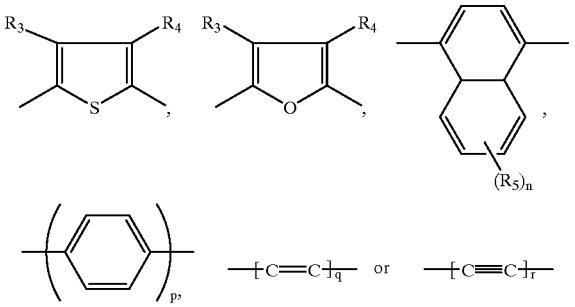

wherein $R_3$, $R_4$ and $R_5$ are independently hydrogen, or substituted or unsubstituted aliphatic or alicyclic groups that do not interfere with the defined requirements of the image stabilizing compounds, n is 0, 1, 2 or 3, p is 1 or 2, and q and r are independently 1 to 10.

Preferably, compounds of Structure I have Z as a benzoxazoyl group, and A is

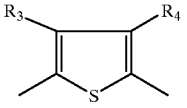

One such compound is Compound A below:

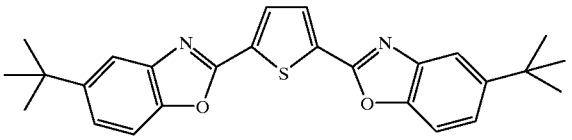

The compounds illustrated by Structure I can be prepared using known starting materials and procedures as described in GB 1,365,996 and GB 1,319,763 or they can be obtained from several commercial sources including Ciba Specialty Chemicals-Additive Division.

One class of primary image stabilizing compounds includes fluorenone compounds. Preferred fluorenone compounds can be represented by the following Structure II:

II

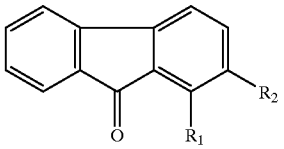

wherein $R_1$ is hydrogen or carboxy and $R_2$ is hydrogen or fluorine. Representative fluorenone compounds include, but are not limited to, fluorenone, 9-fluorenone-1-carboxylic acid and 2-fluoro-9-fluorenone. The fluorenone compounds can be prepared using known procedures as described for example, in *J. Chem.Soc., Perkin Trans.*, 2(3), pages 405–408 (1986), *J.Med.Chem.* 29(10), pages 1904–1912 (1986), *Gazz.Chim.Ital*, 115(2), pages 91–95 (1985), *J.Org.Chem.* 54(5), pages 1144–1149 (1989), and *Synlett*, 7, pages 1067–1068 (1999), or obtained from several commercial sources including Aldrich Chemical Company.

Still another class of primary image stabilizing compounds includes coumarin compounds. Preferred coumarin compounds can be represented by the following Structure III:

III

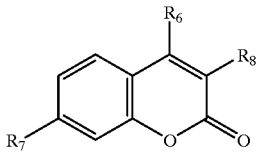

wherein $R_6$ is hydrogen, a substituted or unsubstituted aliphatic, alicyclic, aromatic carbocyclic or heterocyclic group such that the image stabilizing compounds have the defined properties noted above (change in b* values). $R_7$ is hydrogen, an acetyl group or a substituted or unsubstituted dialkylamino group (wherein the each alkyl group can have from 1 to 10 carbon atoms). $R_8$ is hydrogen, carboxy or a substituted or unsubstituted alkylcarbonyl group (wherein the alkyl moiety has from 1 to 10 carbon atoms).

Particularly useful coumarin compounds useful in the practice of this invention include, but are not limited to coumarin, 7-amino-4-methylcoumarin, 7-diethylamino-4-methylcoumarin, 7-dimethylamino-4-trifluoromethylcoumarin, 3-carboxycoumarin, 7-acetoxy-4-methylcoumarin, or 3-acetylcoumarin. The coumarin compounds can be prepared using known procedures as described for example in *Khim.Geterotsikl.Soedin.*, pages 836–841, 830–835 and 1326–1330 (1990), or obtained from several commercial sources including Aldrich Chemical Company.

Certain anthracene compounds are also useful as primary image stabilizing compounds. Representative compounds can be represented by the following general Structure IV:

IV

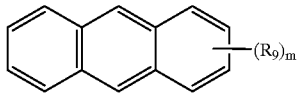

wherein $R_9$ is any substituent other than a halo group such that the compound has the defined properties (change in b* value), and m is 0 to 9. In Structure IV it is understood that substituent groups $(R_9)^m$ may be located on any of the anthracene rings. Examples of such compounds include, but are not limited to, anthracene, 9-phenylanthracene, 9,10-diphenylanthracene and anthracenecarbonitrile. The most preferred anthracene compound is 9,10-diphenylanthracene. The anthracene compounds can be prepared using known procedures as described for example in *Tetrahedron Lett.*, 21(37), pages 3627–3628 (1980), *Tetrahedron*, 38(10), pages 1425–1430 (1982), *J.Am.Chem.Soc.*, 118(21), pages 5154–5155 (1996), *Book of Abstract*, 214$^{th}$ ACS National Meeting (Las Vegas, NV, September 7–11, 1997), *Yingyong Huaxue*, 13(4), pages 113–114 (1996), and *Shanxi Daxue Xuebao, Ziran Kexueban*, 19(2), pages 174–177 (1996), or obtained from several commercial sources including Aldrich Chemical Company.

Still another class of useful primary image stabilizing compounds includes fluorene compounds that can be particularly represented by the following Structure V:

V

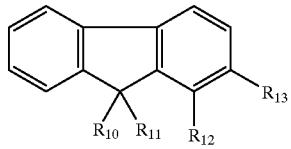

wherein $R_{10}$ and $R_{11}$ are independently hydrogen, a substituted or unsubstituted alkylcarbonyl group (as defined above for Structure III), carboxy, a substituted or unsubstituted carboxyalkyl group (having an alkyl portion of 1 to 10 carbon atoms), a substituted or unsubstituted hydroxyalkyl group having from 1 to 10 carbon atoms and one or more hydroxy groups (such as hydroxymethyl and 2-hydroxyethyl), a substituted or unsubstituted anilino group, a substituted or unsubstituted hydroxyaryl group (such as p-hydroxyphenyl), or a phenoxyalkanol group). $R_{12}$ and $R_{13}$ are independently hydrogen, formyl, carboxy or a substituted or unsubstituted alkylcarbonyl group (as defined above).

Particularly useful fluorene compounds include, but are not limited to, fluorene, 2-acetylfluorene, 9-fluoreneacetic acid, 2-fluorenecarboxaldehyde, 1-fluorenecarboxylic acid, 9-fluorenecarboxylic acid, 9H-fluorene-9,9-dimethanol, 4,4'-(9-fluorenylidene)bis(2-phenoxyethanol), 4,4'-(9-fluorenylidene)dianiline or 4,4'-(9-fluorenylidene)diphenol. The fluorene compounds can be prepared using known procedures as described for example in EP-A-0 512,554, JP Kokai 11-292800, *Org. Lett.* 2(11), pages 1497–1500 (2000) and *J.Chem.Res., Synop.*, 3, pages 82–83 (1997), or obtained from several commercial sources including Aldrich Chemical Company.

Still another class of primary image stabilizing compounds includes naphthalic acid imide compounds. Preferred naphthalic acid imide compounds can be represented by the following Structure VI:

VI

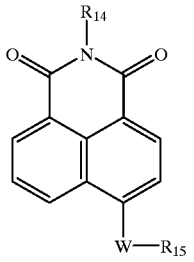

wherein $R_{14}$ and $R_{15}$ each independently represent an alkyl or alkenyl groups of up to 20 carbon atoms, aryl, alkaryl, or aralkyl groups comprising up to 20 carbon atoms, aliphatic heterocyclic ring groups containing up to 6 ring atoms or carbocyclic ring groups comprising up to 6 ring carbon atoms, and W is a nitrogen, oxygen, or sulfur atom, such that the image stabilizing compounds have the defined properties noted above (change in b* values).

Useful naphthalic acid imides can be prepared using conventional procedures described for example in U.S. Pat.

No. 3,330,834 (Senshu et al.), GB 1,054,436 (Mitsubishi Chemical), DE 3,618,458 (Hoechst), Japanese Kokai 47-8065 (Nippon Kayaku Co., Ltd.) and DE 2,064,159 (Sumitomo Chemical Co. Ltd.), or obtained from a number of commercial sources including Maybridge, Ryan Scientific Inc., Namiki Shoji Co., Ltd., CHEMPUR GmbH and Altaquimica.

Still another class of primary image stabilizing compounds includes pyrazoline compounds. Preferred pyrazoline compounds can be represented by the following Structure VII:

VII

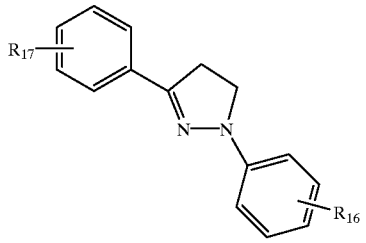

wherein $R_{16}$ and $R_{17}$ each independently represent an alkyl or alkenyl groups of up to 20 carbon atoms, aryl, alkaryl, or aralkyl groups comprising up to 20 carbon atoms, aliphatic heterocyclic ring groups containing up to 6 ring atoms, carbocyclic ring groups comprising up to 6 ring carbon atoms; and alkoxy, alkylthio, aryloxy, and arylthio groups of up to 10 carbon atoms such that the image stabilizing compounds have the defined properties noted above (change in b* values).

Useful pyrazoline compounds can be prepared using conventional procedures as described for example in U.S. Pat. No. 4,904,794 (Meyer), U.S. Pat. No. 5,308,545 (Meyer), DE 3,526,444 (Bayer), DE 3,641,819 (Bayer), DE 2,560,051 (BASF) and Swiss 609,977 (Sandoz), or obtained from a number of commercial sources including Ciba-Geigy Corp., BASF and Aldrich Chemical Co.

The photothermographic materials of this invention can include a mixture of two or more of the described primary image stabilizing compounds (from the same or different classes of compounds) in one or more frontside silver-containing layers [such as the photothermographic emulsion layer(s)]. The mixtures of the compounds can be used in any appropriate molar ratio.

When one or more secondary image stabilizing compounds defined by Structure I are used in combination with one or more primary image stabilizing compounds, the Structure I compounds are generally present at less than 90 mol % of the total image stabilizing compounds in the frontside silver-containing layers, and preferably at less than 50 mol % of the total image stabilizing compounds in the frontside silver-containing layers.

The image stabilizing compound(s) used in the practice of this invention are generally present in the photothermographic materials layers in a total amount of at least 0.01 $mmol/m^2$, and preferably at from about 0.05 to about 0.5 $mmol/m^2$.

Binders

The silver halide, the non-photosensitive source of reducible silver ions, the reducing agent composition, and any other additives used in the present invention are generally present in one or more layers within at least one binder that is either hydrophilic or hydrophobic. Mixtures of either or both types of binders can also be used. It is preferred that the binder be selected from hydrophobic polymeric materials, such as, for example, natural and synthetic resins that are sufficiently polar to hold the other ingredients in solution or suspension.

Examples of typical hydrophobic binders include, but are not limited to, polyvinyl acetals, polyvinyl chloride, polyvinyl acetate, cellulose acetate, cellulose acetate butyrate, polyolefins, polyesters, polystyrenes, polyacrylonitrile, polycarbonates, methacrylate copolymers, maleic anhydride ester copolymers, butadiene-styrene copolymers and other materials readily apparent to one skilled in the art. Copolymers (including terpolymers) are also included in the definition of polymers. The polyvinyl acetals (such as polyvinyl butyral and polyvinyl formal) and vinyl copolymers (such as polyvinyl acetate and polyvinyl chloride) are particularly preferred. A particularly suitable polyvinyl butyral binder is available as BUTVAR®B79 (Monsanto).

Examples of useful hydrophilic binders include, but are not limited to, gelatin and gelatin-like derivatives (hardened or unhardened), cellulosic materials such as cellulose acetate, cellulose acetate butyrate, hydroxymethyl cellulose, acrylamide/methacrylamide polymers, acrylic/methacrylic polymers, polyvinyl pyrrolidones, polyvinyl acetates, polyvinyl alcohols and polysaccharides (such as dextrans and starch ethers).

Where the proportions and activities of the photothermographic materials require a particular developing time and temperature, the binder(s) should be able to withstand those conditions. Generally, it is preferred that the binder not decompose or lose its structural integrity at 120° C. for 60 seconds, and more preferred that it not decompose or lose its structural integrity at 177° C. for 60 seconds.

The polymer binder(s) is used in an amount sufficient to carry the components dispersed therein that is within the effective range of the action as the binder. The effective range can be appropriately determined by one skilled in the art. Preferably, a binder is used at a level of about 10% by weight to about 90% by weight, and more preferably at a level of about 20% by weight to about 70% by weight, based on the total dry weight of the layer in which they are included.

Support Materials

The photothermographic materials of this invention comprise a polymeric support that is preferably a flexible transparent film that has any desired thickness and is composed of one or more polymeric materials depending upon their use. The supports are generally transparent or at least translucent, but in some instances, opaque supports may be useful. They are required to exhibit dimensional stability during development and to have suitable adhesive properties with overlying layers. Useful polymeric materials for making such supports include, but are not limited to, polymers (such as polyethylene terephthalate and polyethylene naphthalate), cellulose acetate and other cellulose esters, polyvinyl acetal, polyolefins (such as polyethylene and polypropylene), polycarbonate, and polystyrenes (and polymers of styrene derivatives). Preferred supports are composed of polymers having good heat stability, such as polyesters and polycarbonates. Polyethylene terephthalate film is the most preferred support. Various support materials are described, for example, in *Research Disclosure* August 1979, publication 18431.

Opaque supports can also be used including dyed polymeric films and resin-coated papers that are stable to high temperatures.

Support materials can contain various colorants, pigments, antihalation or acutance dyes if desired. Support materials may be treated using conventional procedures (such as corona discharge) to improve adhesion of overlying layers, or subbing or other adhesion-promoting layers can be used. Useful subbing layer formulations include those conventionally used for photographic materials including vinylidene halide polymers.

Photothermographic Formulations

The formulation for a photothermographic emulsion layer (s) can be prepared by dissolving and dispersing the binder, the photocatalyst, the non-photo-sensitive source of reducible silver ions, the reducing composition, and optional addenda in an inert organic solvent, such as toluene, 2-butanone, acetone or tetrahydrofuran.

Photothermographic materials can contain plasticizers and lubricants such as polyalcohols and diols of the type described in U.S. Pat. No. 2,960,404 (Milton et al.), fatty acids or esters such as those described in U.S. Pat. No. 2,588,765 (Robijns) and U.S. Pat. No. 3,121,060 (Duane), and silicone resins such as those described in GB 955,061 (DuPont). The materials can also contain matting agents such as starch, titanium dioxide, zinc oxide, silica, and polymeric beads including beads of the type described in U.S. Pat. No. 2,992,101 (Jelley et al.) and U.S. Pat. No. 2,701,245 (Lynn). Polymeric fluorinated surfactants may also be useful in one or more layers of the imaging materials for various purposes, such as improving coatability and optical density uniformity as described in U.S. Pat. No. 5,468,603 (Kub).

EP-A-0 792 476 (Geisler et al.) describes various means of modifying the photothermographic materials to reduce what is known as the "woodgrain" effect, or uneven optical density. This effect can be reduced or eliminated by several means, including treatment of the support, adding matting agents to the topcoat, using acutance dyes in certain layers or other procedures described in the noted publication.

The photothermographic materials can include antistatic or conducting layers. Such layers may contain soluble salts (for example chlorides or nitrates), evaporated metal layers, or ionic polymers such as those described in U.S. Pat. No. 2,861,056 (Minsk) and U.S. Pat. No. 3,206,312 (Sterman et al.), or insoluble inorganic salts such as those described in U.S. Pat. No. 3,428,451 (Trevoy). Other antistatic agents are well known in the art.

The photothermographic materials may also contain electroconductive underlayers to reduce static electricity effects and improve transport through processing equipment. Such layers are described in U.S. Pat. No. 5,310,640 (Markin et al.).

The photothermographic materials can be constructed of one or more layers on a support. Single layer materials should contain the photocatalyst, the non-photosensitive source of reducible silver ions, the reducing composition, the binder, as well as optional materials such as toners, acutance dyes, coating aids and other adjuvants.

Two-layer constructions comprising a single emulsion layer containing all of the ingredients and a protective topcoat are generally found in the materials of this invention. However, two layer constructions containing silver halide and non-photosensitive source of reducible silver ions in one emulsion layer (usually the layer adjacent to the support) and the reducing compositions in a second emulsion layer or distributed between both layers are also envisioned.

Layers to promote adhesion of one layer to another in photothermographic materials are also known, as described for example in U.S. Pat. No. 5,891,610 (Bauer et al.), U.S. Pat. No. 5,804,365 (Bauer et al.) and U.S. Pat. No. 4,741,992 (Przezdziecki).

Photothermographic formulations described can be coated by various coating procedures including wire wound rod coating, dip coating, air knife coating, curtain coating, slide coating or extrusion coating using hoppers of the type described in U.S. Pat. No. 2,681,294 (Beguin). It is preferred that two or more layers can be coated simultaneously by the procedures described in U.S. Pat. No. 2,761,791 (Russell), U.S. Pat. No. 4,001,024 (Dittman et al.), U.S. Pat. No. 4,569,863 (Keopke et al.), U.S. Pat. No. 5,340,613 (Hanzalik et al.), U.S. Pat. No. 5,405,740 (LaBelle), U.S. Pat. No. 5,415,993 (Hanzalik et al.), U.S. Pat. No. 5,733,608 (Kessel et al.), U.S. Pat. No. 5,849,363 (Yapel et al.), U.S. Pat. No. 5,843,530 (Jerry et al.), U.S. Pat. No. 5,861,195 (Bhave et al.) and GB 837,095 (Ilford). A typical coating gap for the emulsion layer can be from about 10 to about 750 $\mu$m, and the layer can be dried in forced air at a temperature of from about 20° C. to about 150° C. It is preferred that the thickness of the layer be selected to provide maximum image densities greater than about 0.2, and more preferably, from about 0.5 to 5.0 or more, as measured by a MacBeth Color Densitometer Model TD 504.

When the layers are coated simultaneously using various coating techniques, it is preferred that the "carrier" layer formulation comprise a single-phase mixture of the two or more polymers described above as described in copending and commonly assigned U.S. Ser. No. 09/510,648 filed Feb. 23, 2000 by Ludemann et al. that is based on Provisional Application 60/121,794 filed Feb. 26, 1999.

Preferably, two or more layers are applied to a film support using slide coating. The first layer can be coated on top of the second layer while the second layer is still wet. The first and second fluids used to coat these layers can be the same or different organic solvents (or organic solvent mixtures).

While the first and second layers can be coated on one side of the film support, the method can also include forming on the opposing or backside side of said polymeric support, one or more additional layers, including an antihalation layer, an antistatic layer, or a layer containing a matting agent (such as silica), or a combination of such layers. Materials having emulsion layers on both sides of the support are also contemplated.

A method of preparing a photothermographic material of this invention comprises:

coating on the same side of a support, one or more formulations comprising a binder and one or more of:

(a) a photosensitive silver halide as defined above, (b) a non-photosensitive source of reducible silver ions as described above, (c) a reducing agent composition for said reducible silver ions as described above, and (d) one or more image stabilizing compounds that are fluorenone, fluorene, coumarin, naphthalic acid imide, pyrazoline, or anthracene compounds as described above.

In one embodiment, all of components (a) to (d) are in the same formulation and thus incorporated into the same layer on the support. In a second embodiment, one or more of components (a) to (c) is in a first formulation to provide a first coating or layer, and a second formulation is coated simultaneously or after the first formulation is coated to provide a topcoat layer. The second formulation or layer comprises component (d) or the one or more image stabilizing compounds. In this embodiment, the image stabilizing compound can diffuse into the lower layer that comprises the photosensitive silver halide.

Photothermographic elements according to the present invention can contain acutance dyes and antihalation dyes. An antihalation layer generally comprises one or more compounds (for example antihalation dyes) that provide antihalation characteristics. Such antihalation dyes may be incorporated into one or more antihalation layers according to known techniques as an antihalation backing layer, an antihalation underlayer or as an overcoat. It is preferred that the photothermographic elements of this invention contain an antihalation coating on the support opposite to the side on which the emulsion and topcoat layers are coated.

An acutance layer generally comprises one or more compounds (for example, acutance dyes) incorporated into the photothermographic emulsion layer to promote image sharpness. Such acutance dyes may be incorporated into one or more frontside layers such as the photothermographic emulsion layer or topcoat layers according to known techniques.

Antihalation and acutance dyes useful in the present invention are described in U.S. Pat. No. 5,135,842 (Kitchin et al.), U.S. Pat. No. 5,266,452 (Kitchin et al.), U.S. Pat. No. 5,314,795 (Helland et al.), and U.S. Pat. No. 5,380,635 (Gomez et al. Dyes particularly useful as antihalation and acutance dyes include dihydroperimidine squarylium antihalation dyes having the nucleus represented by the following Structure VIII:

VIII

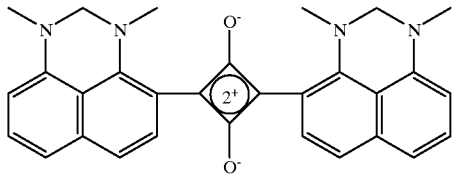

One particularly useful dihydroperimidine squarylium dye is 1,3-bis[2,3-dihydro-2,2-bis[[1-oxohexyl)oxy]methyl]-1H-perimidin-6-yl]-2,4-dihydroxy-, bis(inner salt). Details of such dyes having the dihydroperimidine squarylium nucleus of Structure VIII and methods of their preparation can be found in U.S. Pat. No. 6,063,560 (Suzuki et al.) and U.S. Pat. No. 5,380,635 (Gomez et al.), both incorporated herein by reference.

While the imaging materials of the present invention can be imaged in any suitable manner consistent with the type of material using any suitable imaging source (typically some type of radiation or electronic signal), the following discussion will be directed to the preferred imaging means.

Imaging can be achieved by exposing the photothermographic materials to a suitable source of radiation to which they are sensitive, including ultraviolet light, visible light, near infrared radiation and infrared radiation to provide a latent image. Suitable exposure means are well known and include laser diodes that emit radiation in the desired region, photodiodes and others described in the art, including *Research Disclosure*, Vol. 389, Publication 38957, September 1996 (such as sunlight, xenon lamps and fluorescent lamps). A useful exposure means are laser diodes that are modulated to increase imaging efficiency using what is known as multilongitudinal exposure techniques as described in U.S. Pat. No. 5,780,207 (Mohapatra et al.). Other exposure techniques are described in U.S. Pat. No. 5,493,327 (McCallum et al.).

For use of the materials of this invention, development conditions will vary, depending on the construction used but will typically involve heating the imagewise exposed material at a suitably elevated temperature. Thus, the latent image can be developed by heating the exposed material at a moderately elevated temperature of, for example, from about 50 to about 250° C. (preferably from about 80 to 200° C., more preferably from 100 to about 200° C.) for a sufficient period of time, generally from about 1 to about 120 seconds. Heating can be accomplished using any suitable heating means such as a hot plate, a steam iron, a hot roller or a heating bath.

In some methods, the development is carried out in two steps. Thermal development takes place at a higher temperature for a shorter time (for example at about 150° C. for up to 10 seconds), followed by thermal diffusion at a lower temperature (for example at about 80° C.) in the presence of a transfer solvent. The second heating step prevents further development.

Use as a Photomask

The photothermographic materials of the present invention are sufficiently transmissive in the range of 350–450 nm in non-imaged areas to allow their use in a process where there is a subsequent exposure of an ultraviolet or short wavelength visible radiation sensitive imageable medium. For example, imaging the photothermographic material and subsequent heat development affords a visible image. The heat-developed photothermographic material absorbs ultraviolet or short wavelength visible radiation in the areas where there is a visible image and transmits ultraviolet or short wavelength visible radiation where there is no visible image. The heat-developed material may then be used as a mask and positioned between a source of imaging radiation (such as an ultraviolet or short wavelength visible radiation energy source) and an imageable material that is sensitive to such imaging radiation, such as, for example, a photopolymer, diazo material, photoresist, or photosensitive printing plate. Exposing the imageable material to the imaging radiation through the visible image in the exposed and heat-developed photothermographic material provides an image in the imageable material. This process is particularly useful where the imageable medium comprises a printing plate and the photothermographic material serves as an imagesetting film.

The following examples are provided to illustrate the practice of this invention, and are not intended to be limiting in any manner.

EXAMPLES 1–3

Several compounds were screened for usefulness as image stabilizing compounds in photothermographic materials by incorporating them in photothermographic emulsion layers and evaluating them for their ability to provide image stability by means of measuring the blue $D_{min}$ values after certain time on a conventional light-box. In these examples, the image stabilizing compounds were mixed in the topcoat formulation, but they were found to diffuse into the imaging layer. The image stabilizing compounds can be put directly into the imaging layer formulation if desired.

The photothermographic imaging formulation was prepared as follows:

An emulsion of silver behenate full soap containing preformed silver halide grains (as described in U.S. Pat. No. 5,939,249, noted above) was homogenized to 26.5% solids in methyl ethyl ketone using 2.8% Pioloform BS-18 (available from Wacker Polymer Systems, Adrian, MI). To 170 g of this silver soap emulsion was added methyl ethyl ketone (40 g) and pyridinium hydrobromide perbromide (0.23 g) with stirring. After 60 minutes of mixing, a zinc bromide solution (2 ml, 10%) in methanol was added. Stirring was continued and 2-mercapto-5-methylbenzimidazole (0.14 g), benzothiazolium, 3-ethyl-2-[[7-[[3-ethyl-5-(methylthio)-2(3H)-benzothiazolylidene] methyl]-4,4a, 5,6-tetrahydro-2(3H)-naphthalenylidene] methyl]-5-(methylthio)-, iodide (0.0067 g) and 2-(4-chlorobenzoyl)benzoic acid (2 g) were added to the formulation with methanol (6 g) after 30 minutes. The formulation temperature was reduced to 10° C. after stirring for 60 minutes. After stirring for another 30 minutes, Pioloform BL-16 (43.4 g) was added with mixing. The formulation was completed by mixing for 15 minutes between the each of the following additions:

2-(Tribromomethylsulfonyl)quinoline (0.31 g),

LOWINOX 221B446 2,2'-isobutylidene-bis(4,6-dimethylphenol) antioxidant (9 g), (Available from Chem Werke, Lowi).

Diisocyanate DESMODUR N3300 (THDI) (0.62 g),
Tetrachlorophthalic acid (0.35 g),
Phthalazine (1.26 g),
4-Methylphthalic acid (0.57 g), and
1-(Methylsulfonyl)-1H-benzotriazole (0.08 g).

A topcoat formulation was prepared as follows:

ACRYLOID A-21 acrylic resin (0.56 g, Rohm & Haas),

Cellulose acetate butyrate resin (CAB 171-15S, 15 g, Eastman Chemical Company),

Methyl ethyl ketone (2-butanone, MEK) (183 g),

Vinyl sulfone (0.4 g), (Vinyl Sulfone-1 (VS-1) is described in EP-B-0 600 589.

Benzotriazole (0.16 g),

Ethyl-2-cyano-3-oxobutanoate (0.18 g),

Squarylium dye: 1,3-bis[2,3-dihydro-2,2-bis[[1-oxohexyl)oxy]-methyl]-1H-perimidin-6-yl]-2,4-dihydroxy-, bis(inner salt) (0.18 g).

Mixture of 2-bromo-2-tribromomethylsulfonylbutane (80%) and 2-bromomethylsulfonylbutane (20%) (0.189 g), Diisocyanate DESMODUR N3300 (THDI) (1 g, Bayer Chemicals Co.), and Image stabilizing compound (see TABLE I below).

The imaging and topcoat formulations were simultaneously coated onto a 178 $\mu$m poly(ethylene terephthalate) film support using a dual knife coater. The coating gap for the photothermographic emulsion layer was set at 3.6 mil (91.4 $\mu$m) above the support. The coating gap of the topcoat layer was set at 5.5 mil (139.7 $\mu$m) above the support.

Each film sample was imagewise exposed and processed to minimum image density ($D_{min}$). The samples were evaluated on a conventional Picker light-box where they were exposed to about 107° F. (41.5° C.) and a fluorescent light intensity of about 425 foot-candles (4590 lux). The change in $D_{min}$ in each sample in the blue region of the electromagnetic spectrum was measured using a conventional densitometer (Xrite Model 310) in the blue A mode. The silver coating weight of each film sample was measured using a conventional X-ray fluorescence silver gauge.

The compounds tested in this example as image stabilizing compounds were anthracene (Example 1), 9-phenylanthracene (Example 2) and 9,10-diphenylanthracene (Example 3). TABLE I below shows the change in blue $D_{min}$ values after certain days of exposure to the light box.

TABLE I

| Film Sample | Image Stabilizing Compound (mmol/m$^2$) | Initial b* | 1 Day | 15 Days | 23 Days | 32 Days | 39 Days | Ag (g/m$^2$) |
|---|---|---|---|---|---|---|---|---|
| Control A | 0 | −7.27 | 0.05 | 0.073 | 0.127 | 0.167 | 0.173 | 1.94 |
| Example 1 | 0.61 | −7.31 | 0.04 | 0.053 | 0.060 | 0.063 | 0.072 | 1.95 |
| Control B | 0 | −7.40 | 0.048 | 0.071 | 0.135 | 0.203 | 0.211 | 2.07 |
| Example 2 | 0.26 | −7.40 | 0.040 | 0.053 | 0.066 | 0.075 | 0.083 | 1.97 |
| Control C | 0 | −7.10 | 0.045 | 0.066 | 0.119 | 0.162 | 0.176 | 1.84 |
| Example 3 | 0.20 | −7.00 | 0.043 | 0.060 | 0.064 | 0.065 | 0.068 | 1.81 |

The data shown in TABLE I indicate that browning was observed in the Control materials after about two weeks of light-box exposure. The use of the anthracene compounds in the photothermographic emulsion layer according to the present invention suppressed this browning effect by providing improved image stability.

EXAMPLE 4

Photothermographic materials of the present invention were prepared and evaluated as described in Examples 1–3 except that benzofluorene was used in place of the anthracene compounds as an image stabilizing compound in the present invention. TABLE II below shows the change in blue $D_{min}$ values after certain days of exposure to the light box. Browning in the Control film sample was observed after about two weeks, but the use of the benzofluorene compound improved image stability.

TABLE II

| Film Sample | Image Stabilizing Compound (mmol/m$^2$) | Initial b* | 1 Day | 15 Days | 23 Days | 32 Days | 39 Days | Ag (g/m$^2$) |
|---|---|---|---|---|---|---|---|---|
| Control D | 0 | −7.50 | 0.043 | 0.067 | 0.127 | 0.179 | 0.214 | 1.87 |
| Example 4 | 0.30 | −7.40 | 0.046 | 0.066 | 0.082 | 0.097 | 0.102 | 1.88 |

EXAMPLES 5–6

Photothermographic materials of the present invention were prepared and evaluated as described in Examples 1–3 except that 7-diethylamino-4-methylcoumarin was used in place of the anthracene compounds as an image stabilizing compound according to the present invention. On the Picker light box, the materials were exposed to about 118° F. (48° C.) and a fluorescent light intensity of about 600 foot-candles (6480 lux). TABLE III below shows the change in blue $D_{min}$ values after certain days of exposure to the light box. The data indicate that the noted coumarin compound provided improved image stability in the photothermographic materials.

TABLE III

| Film Sample | Image Stabilizing Compound (mmol/m$^2$) | Initial b* | 1.5 Days | 14 Days | 24 Days | 31 Days | Ag (g/m$^2$) |
|---|---|---|---|---|---|---|---|
| Control E | 0 | −7.56 | 0.067 | 0.252 | 0.499 | 0.691 | 2.02 |
| Example 5 | 0.19 | −7.15 | 0.089 | 0.177 | 0.278 | 0.301 | 2.04 |
| Example 6 | 0.37 | −7.53 | 0.084 | 0.154 | 0.182 | 0.193 | 2.00 |

EXAMPLES 7–10

Photothermographic materials of the present invention were prepared and evaluated as described in Examples 1–3 except that fluorenone (Example 6), fluorene (Example 7), 2,5-bis(4-biphenylyl)-1,2,4-oxadiazole (Example 8), and a combination (1:7.3 molar ratio) of 2,5-bis(4-biphenylyl)-1,3,4-oxadiazole and anthracene (Example 9) were used as image stabilizing agents. Anthracene was tested a second time (example 1B) as an image stabilizing compound. On the Picker light box, the materials were exposed as described in Examples 1–3. TABLE IV below shows the change in blue $D_{min}$ values after certain days of exposure to the light box. The data indicate that the noted light stabilizing compounds provided improved image stability in the photothermographic materials.

The invention has been described in detail with particular reference to certain preferred embodiments thereof, but it will be understood that variations and modifications can be effected within the spirit and scope of the invention.

TABLE IV

| Film Sample | Image Stabilizing Compound (mmol/m$^2$) | Initial b* | 1 Day | 15 Days | 22 Days | 33 Days | 37 Days | Ag (g/m$^2$) |
|---|---|---|---|---|---|---|---|---|
| Control F | 0 | −6.7 | 0.038 | 0.151 | 0.310 | 0.491 | 0.509 | 1.89 |
| Example 7 | 0.60 | −6.49 | 0.037 | 0.145 | 0.235 | 0.296 | 0.298 | 1.88 |
| Example 8 | 0.65 | −6.56 | 0.041 | 0.128 | 0.221 | 0.295 | 0.298 | 1.90 |
| Control G | 0 | −6.7 | 0.039 | 0.198 | 0.398 | 0.621 | 0.673 | 1.89 |
| Example 1B | 0.85 | −6.59 | 0.043 | 0.134 | 0.213 | 0.280 | 0.288 | 1.92 |
| Example 9 | 0.10 | −6.37 | 0.037 | 0.103 | 0.170 | 0.246 | 0.258 | 1.89 |
| Example 10 | 0.10/0.73 | −6.17 | 0.040 | 0.074 | 0.085 | 0.098 | 0.095 | 1.87 |

We claim:

1. A photothermographic material comprising a support having thereon one or more frontside layers comprising a binder, and in reactive association:

(a) a photosensitive silver halide, (b) a non-photosensitive source of reducible silver ions, and (c) a reducing agent composition for said reducible silver ions, said material further comprising in said one or more frontside silver-containing layers one or more primary image stabilizing compounds that are fluorenone, fluorene, coumarin, naphthalic acid imide, pyrazoline, or anthracene compounds.

2. The material of claim 1 wherein said one or more frontside layers further comprise a polyhalo antifoggant.

3. The material of claim 2 wherein said polyhalo antifoggant is compound A-1, A-2, A-3 or A-4 below:

A-1

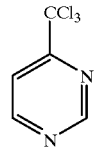

A-2

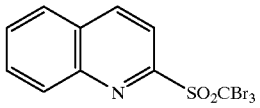

-continued

A-3

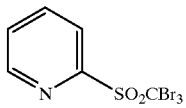

A-4

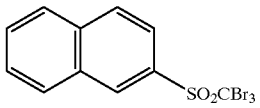

A-5

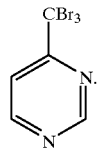

4. The material of claim 2 wherein said polyhalo antifoggant is present in an amount of at least 0.04 mmol/m$^2$.

5. The material of claim 1 wherein one or more frontside layers further comprise one or more secondary image stabilizing compounds represented by the following Structure I:

I

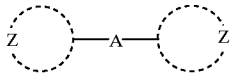

wherein Z is a 2-benzoxazoyl group, a benzothiazolyl group, a triazinyl group, or a benzimidazolyl group, and A is a bridging group that forms a continuous chain of conjugated double or triple bonds with the Z group.

6. The material of claim 5 wherein said Z group is:

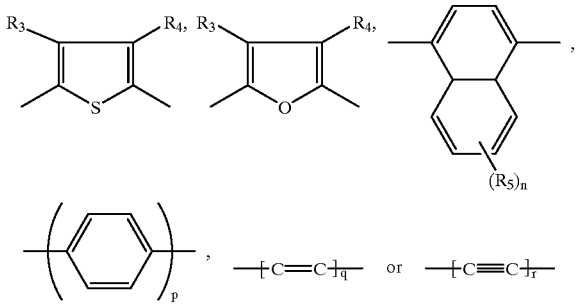

wherein $R_3$, $R_4$ and $R_5$ are independently hydrogen, or aliphatic or alicyclic groups, n is 0, 1, 2 or 3, p is 1 or 2, and r are independently 1 to 10, wherein said secondary image stabilizing compound comprises less than 90 mol % of the total image stabilizing compounds in said one or more frontside layers.

7. The material of claim 5 wherein said secondary image stabilizing compound is 2,5-bis(5-t-butyl-2-benzoxazolyl) thiophene.

8. The material of claim 1 wherein said primary image stabilizing compound is a fluorenone compound represented by the following Structure II:

II

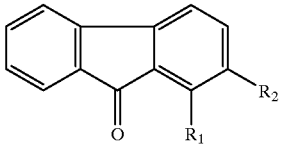

wherein $R_1$ is hydrogen or carboxy and $R_2$ is hydrogen or fluorine.

9. The material of claim 8 wherein said fluorenone compound is fluorenone, 9-fluorenone-1-carboxylic acid or 2-fluoro-9-fluorenone.

10. The material of claim 1 wherein said primary image stabilizing agent is a coumarin compound represented by the following Structure III:

III

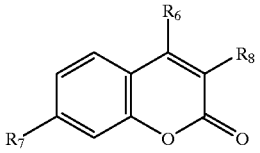

wherein $R_6$ is hydrogen, or an aliphatic, alicyclic or aromatic carbocyclic or heterocyclic group, $R_7$ is hydrogen, an acetyl group or a dialkylamino group, and $R_8$ hydrogen, carboxy or an alkylcarbonyl group.

11. The material of claim 10 wherein said coumarin compound is coumarin, 7-amino-4-methylcoumarin, 7-diethylamino-4-methylcoumarin, 7-dimethylamino-4-trifluoromethylcoumarin, 3-carboxycoumarin, 7-acetoxy-4-methylcoumarin, or 3-acetylcoumarin.

12. The material of claim 1 wherein said primary image stabilizing agent is an anthracene compound represented by the following Structure IV:

IV

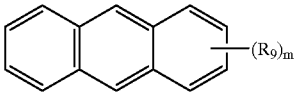

wherein $R_9$ is any substituent other than a halo group, and m is 0 to 9.

13. The material of claim 12 wherein said anthracene compound is anthracene, 9-phenylanthracene, 9,10-diphenylanthracene or anthradenecarbonitrile.

14. The material of claim 1 wherein said primary image stabilizing agent is a fluorene compound represented by the following Structure V:

V

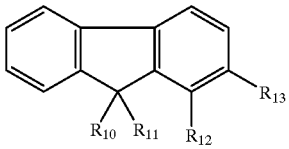

wherein $R_{10}$ and $R_{11}$ are independently hydrogen, an alkylcarbonyl group, carboxy, a carboxyalkyl group, a hydroxyalkyl group, an anilino group, a hydroxyaryl group, or a phenoxyalkanol group, and $R_{12}$ and $R_{13}$ are independently hydrogen, formyl, carboxy or an alkylcarbonyl group.

15. The material of claim 14 wherein said fluorene compound is fluorene, 2-acetylfluorene, 9-fluoreneacetic acid, 2-fluorenecarboxaldehyde, 1-fluorenecarboxylic acid, 9-fluorenecarboxylic acid, 9H-fluorene-9,9-dimethanol, 4,4'-(9-fluorenylidene)bis(2-phenoxyethanol), 4,4'-(9-fluorenylidene)dianiline or 4,4'-(9-fluorenylidene)diphenol.

16. The material of claim 1 wherein said primary image stabilizing agent is a naphthalic acid imide compound represented by the following Structure VI:

VI

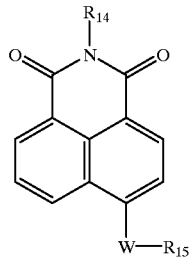

wherein $R_{14}$ and $R_{15}$ each independently represent an alkyl or alkenyl groups of up to 20 carbon atoms, aryl, alkaryl, or aralkyl groups comprising up to 20 carbon atoms, aliphatic heterocyclic ring groups containing up to 6 ring atoms or carbocyclic ring groups comprising up to 6 ring carbon atoms, and W is a nitrogen, oxygen, or sulfur atom.

17. The material of claim 1 wherein said primary image stabilizing compound is a pyrazoline compound represented by the Structure VII:

VII

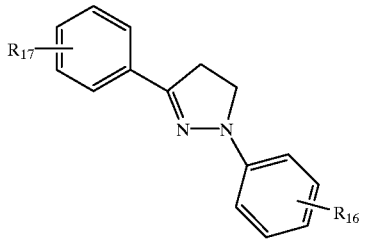

wherein $R_{16}$ and $R_{17}$ each independently represent an alkyl or alkenyl groups of up to 20 carbon atoms, aryl, alkaryl, or aralkyl groups comprising up to 20 carbon atoms, aliphatic heterocyclic ring groups containing up to 6 ring atoms, carbocyclic ring groups comprising up to 6 ring carbon atoms, and alkoxy, alkylthio, aryloxy, and arylthio groups of up to 10 carbon atoms.

18. The material of claim 1 wherein said primary image stabilizing agent is present in said frontside layer(s) in an amount of at least 0.01 mmol/$m^2$.

19. The material of claim 1 wherein said non-photosensitive source of reducible silver ions comprises a silver salt of an aliphatic carboxylic acid having from 10 to 30 carbon atoms, or a mixture thereof, and said binder is a hydrophobic binder.

20. The material of claim 1 further comprising a dihydroperimidine squarylium dye in said one or more frontside layers or in a backside layer, or both, said dihydroperimidine squarylium dye having the nucleus represented by the following Structure VIII:

VIII

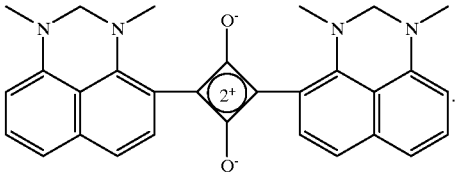

21. The material of claim 1 wherein said components (a) and (b) and said primary image stabilizing compound are present in the same frontside layer.

22. A method of providing an image comprising the steps of:

A) imagewise exposing the photothermographic material of claim 1 to form a latent image, and B) simultaneously or sequentially, heating said photothermographic material to provide a visible image.

23. The method of claim 22 wherein said photothermographic material is imagewise exposed using electromagnetic radiation in the visible region.

24. The method of claim 22 wherein said photothermographic material is imagewise exposed using near-infrared or infrared radiation.

25. The method of claim 24 wherein said photothermographic material is imagewise exposed using an infrared emitting laser in a multilongitudinal mode.

26. The method of claim 22 wherein said photothermographic support is transparent and said method further comprises:

C) positioning said exposed and heat-developed photothermographic material between a source of imaging radiation and an imageable material that is sensitive to said imaging radiation, and D) exposing said imageable material to said imaging radiation through the visible image in said exposed and heat-developed photothermographic material to provide an image in said imageable material.

27. A method of preparing a photothermographic material comprising:

coating on the same side of a support, one or more formulations comprising a binder and one or more of:

(a) a photosensitive silver halide, (b) a non-photosensitive source of reducible silver ions, (c) a reducing agent composition for said reducible silver ions, and (d) one or more image stabilizing compounds that are fluorenone, fluorene, coumarin, naphthalic acid imide, pyrazoline, or anthracene compounds.

28. The method of claim 27 wherein all of said (a) to (d) are in the same formulation.

29. The method of claim 27 wherein one or more of (a) to (c) is in a first formulation, and a second formulation is coated simultaneously or after said first formulation is coated to provide a topcoat layer, said second formulation comprising (d).

30. A method for preparing a photothermographic material comprising:

A) applying to a support one or more formulations to form one or more layers on one side of the support, said one or more formulations including components (a), (b) and (c) and thereby forming at least one silver-containing layer:

(a) a photosensitive silver halide, (b) a non-photosensitive source of reducible silver ions, and (c) a reducing agent composition for said reducible silver ions, B) simultaneously or sequentially, applying a second formulation including one or more primary fluorenone, fluorene, coumarin, naphthalic acid imide, pyrazoline, or anthracene image stabilizing compounds to form a layer that is different from the layers formed in A), and C) allowing said one or more primary image stabilizing compounds to diffuse into a silver-containing layer formed in A).

* * * * *